US008519921B2

(12) United States Patent
Lee et al.

(10) Patent No.: US 8,519,921 B2
(45) Date of Patent: Aug. 27, 2013

(54) ORGANIC LIGHT EMITTING DIODE (OLED) DISPLAY ADJUSTING FOR AMBIENT ILLUMINANCE AND A METHOD OF DRIVING THE SAME

(75) Inventors: Duk-Jin Lee, Suwon-si (KR); Jeong-No Lee, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 916 days.

(21) Appl. No.: 12/007,638

(22) Filed: Jan. 14, 2008

(65) Prior Publication Data

US 2008/0246749 A1 Oct. 9, 2008

(30) Foreign Application Priority Data

Apr. 6, 2007 (KR) ..... 10-2007-0034398

(51) Int. Cl.
*G09G 3/32* (2006.01)

(52) U.S. Cl.
USPC ..... 345/83; 345/207

(58) Field of Classification Search
USPC ..... 345/76–83, 207
See application file for complete search history.

(56) References Cited

U.S. PATENT DOCUMENTS

| | | | | |
|---|---|---|---|---|
| 6,473,065 | B1 * | 10/2002 | Fan | 345/82 |
| 6,897,641 | B1 * | 5/2005 | Herbert | 323/282 |
| 7,212,187 | B2 * | 5/2007 | Park et al | 345/100 |
| 7,768,486 | B2 * | 8/2010 | Park et al. | 345/77 |
| 2003/0201955 | A1 * | 10/2003 | Song et al. | 345/76 |
| 2005/0030214 | A1 | 2/2005 | Jo | |
| 2005/0041003 | A1 | 2/2005 | Yamada | |
| 2006/0066533 | A1 * | 3/2006 | Sato et al. | 345/76 |
| 2006/0126318 | A1 * | 6/2006 | Mechi | 361/836 |
| 2006/0132113 | A1 * | 6/2006 | Cha et al. | 323/282 |
| 2006/0181553 | A1 * | 8/2006 | Choe et al. | 345/690 |
| 2006/0244387 | A1 | 11/2006 | Park et al. | |
| 2006/0269052 | A1 * | 11/2006 | Karnad | 379/399.01 |
| 2006/0273999 | A1 * | 12/2006 | Yamazaki et al. | 345/81 |
| 2007/0001940 | A1 * | 1/2007 | Jo | 345/77 |
| 2007/0097041 | A1 * | 5/2007 | Park et al. | 345/77 |
| 2007/0242002 | A1 * | 10/2007 | Kawabe | 345/76 |
| 2007/0273701 | A1 * | 11/2007 | Mizukoshi et al. | 345/531 |
| 2008/0007544 | A1 * | 1/2008 | Huang et al. | 345/211 |

FOREIGN PATENT DOCUMENTS

| | | | |
|---|---|---|---|
| CN | 1855204 | A | 11/2006 |
| EP | 1 469 449 | A1 | 10/2004 |
| JP | 2004-029714 | A | 1/2004 |
| JP | 2006-047578 | A | 2/2006 |

(Continued)

*Primary Examiner* — Chanh Nguyen
*Assistant Examiner* — Jonathan Blancha
(74) *Attorney, Agent, or Firm* — Lee & Morse, P.C.

(57) ABSTRACT

An organic light emitting diode (OLED) display includes an illuminance sensing unit configured to sense an external illuminance, a brightness determination unit configured to determine a brightness of the OLED display according to an illuminance sensed by the illuminance sensing unit, a driving voltage determination unit configured to determine a driving voltage corresponding with a current saturation point of the OLED display, the driving voltage being determined based at least in part on a driving current and the brightness determined by the brightness determination unit, a voltage conversion unit configured to receive an input voltage, generate a first voltage higher than the input voltage, and generate a second voltage lower than the input voltage, and a display unit configured to receive the first and second voltages from the voltage conversion unit and display an image.

17 Claims, 4 Drawing Sheets

(56) References Cited

FOREIGN PATENT DOCUMENTS

| | | | |
|---|---|---|---|
| JP | 2006-350311 | A | 12/2006 |
| JP | 2007-079585 | A | 3/2007 |
| KR | 10-2004-0078438 | A | 9/2004 |
| KR | 10-0523378 | B1 | 10/2005 |
| KR | 10-2005-0123325 | A | 12/2005 |
| KR | 10-2006-0053455 | A | 5/2006 |
| WO | WO 03/058590 | A1 | 7/2003 |
| WO | WO 2005/101267 | A2 | 10/2005 |

* cited by examiner

ORGANIC LIGHT EMITTING DIODE (OLED) DISPLAY ADJUSTING FOR AMBIENT ILLUMINANCE AND A METHOD OF DRIVING THE SAME

BACKGROUND OF THE INVENTION

1. Field of the Invention

Embodiments relate to a display apparatus capable of being driven with reduced power consumption, and a method of driving the same.

2. Description of the Related Art

Recently, as digital technology continues to grow, various display apparatuses have been developed. In particular, flat panel displays in which a plurality of pixels constitute images, e.g., liquid crystal displays (LCDs), plasma display panels (PDPs), and organic light emitting diode (OLED) displays have been developed.

Among these flat panel displays, particular attention has been paid to OLED displays having advantages such as high brightness, self-emission, a wide viewing angle, and a rapid response speed.

In general, OLED displays emit light in proportion to a driving current supplied to OLEDs of the OLED display from driving transistors. Thus, a desired grayscale may be displayed on the OLED display by adjusting the driving current amount or the duty of the emission duration of the OLEDs.

Meanwhile, various attempts have been made to create high-quality images by driving an OLED display with low power. For example, OLED displays have been developed that may be capable of performing an auto brightness control (ABC) function such that brightness may be automatically adjusted according to an external illuminance. In OLED displays such as these, as the illuminance of external light decreases, brightness is reduced. That is, the reduction of brightness is accomplished by reducing a driving current to thereby prevent a waste of power. The brightness may be adjusted according to an external illuminance by using a driving current reducer.

Generally, as brightness decreases, a driving voltage to reach a current saturation point decreases. Thus, when the illuminance of external light is sensed as being at a low level, and thus brightness of an OLED display may be reduced, a driving current corresponding to the brightness may reach a saturation region at a relatively low driving voltage. However, in conventional OLED displays, a driving voltage may still be provided at a level that may lead to a waste of power.

Accordingly, there remains a need for an OLED display and a method of driving the same that may address one or more of these limitations of the conventional art.

SUMMARY OF THE INVENTION

Embodiments are therefore directed to an organic light emitting diode (OLED) display, and a method of driving the same.

It is therefore a feature of an embodiment of the present invention to provide an OLED display that may be operated with reduced power consumption as compared to the conventional art.

It is therefore another feature of an embodiment of the present invention to provide a method of driving an OLED display at a reduced power as compared to the conventional art.

At least one of the above and other features of the present invention may be realized by providing an OLED display including an illuminance sensing unit configured to sense an external illuminance, a brightness determination unit configured to determine a brightness of the OLED display according to an illuminance sensed by the illuminance sensing unit, a driving voltage determination unit configured to determine a driving voltage corresponding with a current saturation point of the OLED display, the driving voltage being determined based at least in part on a driving current and the brightness determined by the brightness determination unit, a voltage conversion unit configured to receive an input voltage, generate a first voltage higher than the input voltage, and generate a second voltage lower than the input voltage, and a display unit configured to receive the first and second voltages from the voltage conversion unit and display an image.

The illuminance sensing unit may include a photosensor. The brightness determination unit may be configured to access a first lookup table of brightness values of the OLED display corresponding with an illuminance. Furthermore, the driving voltage determination unit may be configured to access a second lookup table of a driving voltage at a current saturation point of the OLED display corresponding with a brightness of the OLED display.

The display unit may include a plurality of pixels, each pixel including a driving transistor having a gate electrode and a first electrode, the gate electrode configured to receive a data voltage and the first electrode configured to receive the first voltage, and an OLED having an anode connected to a second electrode of the driving transistor and a cathode configured to receive the second voltage.

The voltage conversion unit may include a variable resistance for adjusting the driving voltage and generating the second voltage. The voltage conversion unit may further include a booster converter configured to generate the first voltage, and a buck converter configured to generate the second voltage. The buck converter may include a variable resistance, and the buck converter may be configured to adjust the variable resistance based at least in part on the driving voltage determined by the driving voltage determination unit.

At least one other of the above and other features and advantages of the present invention may be realized by providing a method of driving an organic light emitting diode (OLED) display, the method including sensing an external illuminance, determining a brightness of the OLED display according to the sensed illuminance, determining a driving voltage at a current saturation point for the OLED display based at least in part on a driving current corresponding to the determined brightness, receiving an input voltage from an input voltage source, generating a first voltage higher than the input voltage and a second voltage lower than the input voltage, and providing the first voltage and the second voltage to a display unit to display an image on the display unit.

Determining a brightness of the OLED display may further include accessing a first lookup table of brightness values of the OLED display corresponding with an illuminance. Determining a brightness may further include accessing a first graph of brightness values of the OLED display corresponding with an illuminance.

Determining a driving voltage may further include accessing a lookup table of a driving voltage at a current saturation point of the OLED display corresponding with a brightness of the OLED display. Determining a driving voltage may further include accessing a graph of driving voltages of the OLED display corresponding with brightness of the OLED display.

Generating the second voltage may further include adjusting a resistance of a variable resistor in accordance with a control signal corresponding to the determined driving voltage.

The display unit may include a plurality of pixels, each pixel having a driving transistor having a gate electrode receiving a data voltage, and an OLED having an anode and a cathode, wherein providing the first voltage and the second voltage to the OLED display unit further includes supplying the first voltage to the first electrode of the driving transistor, and supplying the second voltage to a cathode of the OLED.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Korean Patent Application No. 10-2007-0034398, filed on Apr. 6, 2007, in the Korean Intellectual Property Office, and entitled: "Organic Light-Emitting Display and Method of Driving the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set fourth herein. Rather, these embodiments are provided so that this disclosure will be thorough and complete, and will fully convey the scope of the invention to those skilled in the art.

In the accompanying drawings, dimensions may be exaggerated for clarity of illustration. Furthermore, although the terms first, second, etc. may be used herein to describe various elements, these elements should not be limited by these terms. These terms are used to distinguish one element from another. For example, a first element could be termed a second element, and similarly, a second element could be termed a first element, without departing from the scope of the present invention. As used herein, the term "and/or" includes any and all combinations of one or more of the associated listed items.

Additionally, it will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent", etc.).

Figure 1:
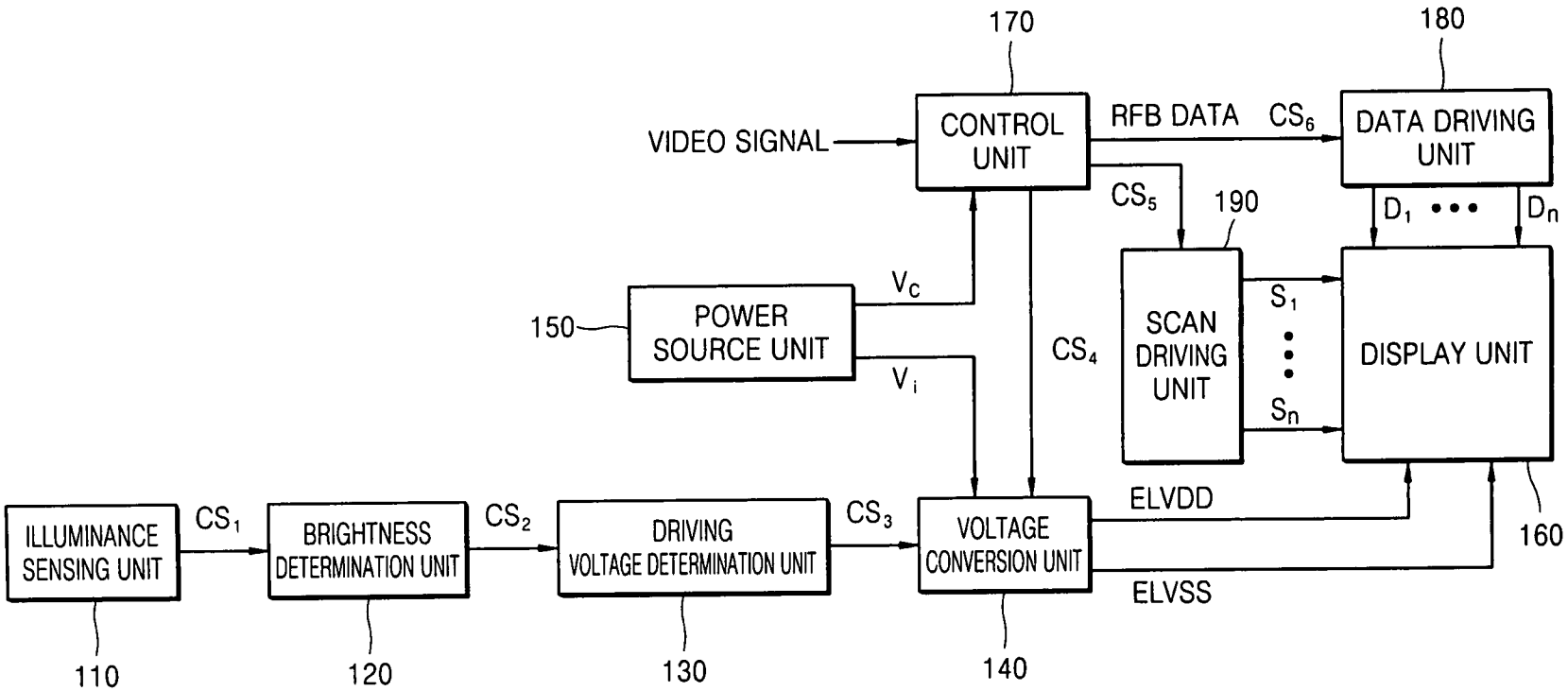
FIG. 1 illustrates a block diagram of organic light emitting diode (OLED) display circuitry according to an embodiment of the present invention.

FIG. 1 illustrates a block diagram of circuitry of an organic light emitting diode (OLED) display that may be capable of being operated at a reduced power consumption according to an embodiment of the present invention. A method of driving the OLED display circuitry illustrated in FIG. 1 will also be described in detail later with reference to FIG. 1, Table 1 and FIGS. 2 and 3.

Referring to FIG. 1, the OLED display circuitry includes an illuminance sensing unit 110, a brightness determination unit 120, a driving voltage determination unit 130, a voltage conversion unit 140, and a display unit 160. The illuminance sensing unit 110 includes a photosensor, and may be capable of sensing an external illuminance by converting an external light signal into an electrical signal and measuring the electrical signal.

The brightness determination unit 120 may be capable of determining the appropriate brightness of the OLED display that may correspond to the sensed illuminance. The appropriate brightness may be indicated by a first control signal $CS_1$. The brightness determination unit 120 may be further capable of storing a first lookup table showing brightness with respect to an external illuminance and/or a first graph illustrating a relationship between brightness with respect to an external illuminance. An external illuminance and brightness that have been previously stored may be embodied in a database, and the database may be embodied in the first lookup table or the first graph. The first lookup table and/or the first graph may be embodied on a storage medium such as a computer-readable storage medium, for example.

Table 1 below illustrates a first lookup table in accordance with an embodiment. In Table 1, if an external illuminance is approximately 500 lux, or approximately an indoor lighting level, the corresponding brightness of a display apparatus according to Table 1 may be approximately 90 cd/m2. Furthermore, if the external illuminance is approximately 60 lux, the brightness of the display apparatus according to Table 1 may be approximately 45 cd/m2. However, it is worthwhile to note that this is just one embodiment, and embodiments of the present invention are not so limited.

TABLE 1

| Illuminance (lux) | Brightness (cd/m$^2$) |
|---|---|
| 500 | 90 |
| 60 | 45 |

Thus, in this embodiment, if the OLED display is placed under indoor lighting conditions, the illuminance sensing unit 110 may sense an external illuminance of approximately 500 lux, and may transmit the first control signal $CS_1$ corresponding to approximately 500 lux to the brightness determination unit 120. The brightness determination unit 120 may select approximately 90 cd/m2 as an appropriate brightness of the display apparatus according to the first control signal $CS_1$ corresponding to approximately 500 lux.

The brightness determination unit 120 may transmit a second control signal $CS_2$ corresponding to the determined brightness to the driving voltage determination unit 130. The driving voltage determination unit 130 may receive the second control signal $CS_2$ and may determine a driving voltage at a current saturation point according to the second control signal $CS_2$.

Figure 2:
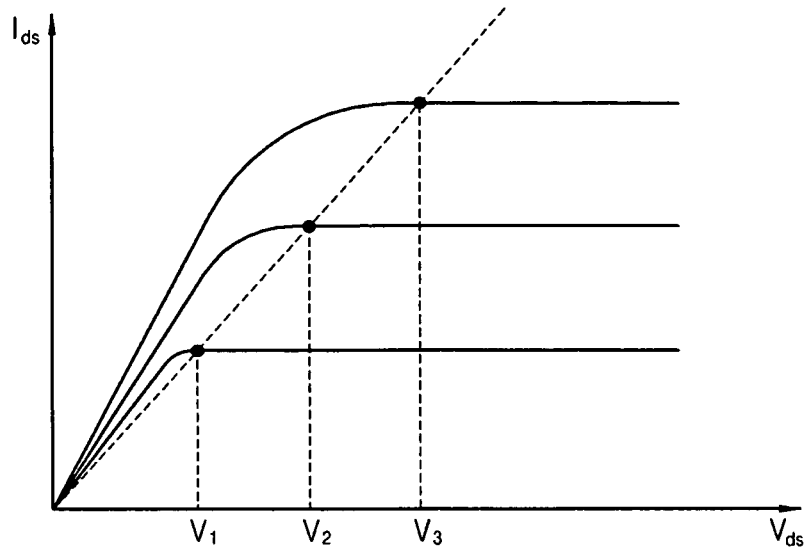
FIG. 2 illustrates a graph of a relationship between a driving current and a driving voltage supplied to the OLED display circuitry illustrated in FIG. 1.

As brightness decreases, a driving voltage at a current saturation point may decrease. Referring to FIG. 2, there is illustrated a relationship between a driving current and a driving voltage with respect to a current saturation point. The driving current and the driving voltage may be supplied to an OLED of the OLED display in accordance with an embodiment. In this embodiment, as a driving current $I_{ds}$ of a saturation region decreases, a driving voltage $V_{ds}$ at a current saturation point decreases. Thus, as brightness decreases, the driving voltage $V_{ds}$ at a current saturation point decreases.

For example, in an OLED display using $V_3$ as a maximum driving voltage at maximum brightness, it may be demonstrated from Table 1 above that if an external illuminance is sensed as approximately 500 lux and approximately 60 lux and thus brightness values are determined as approximately 90 cd/m$^2$ and approximately 45 cd/m$^2$, respectively. Accordingly, driving voltages may be determined as $V_2$ and $V_1$ according to driving currents corresponding to the brightness values. Thus, in an environment in which an external illuminance is low, it may be desirable to reduce brightness. Accordingly, a driving current may be reduced and a driving voltage at a current saturation point may be reduced. A driving voltage reduced in such a manner is supplied to the display unit 170, and may thereby result in a reduction in power consumption.

Figure 3:
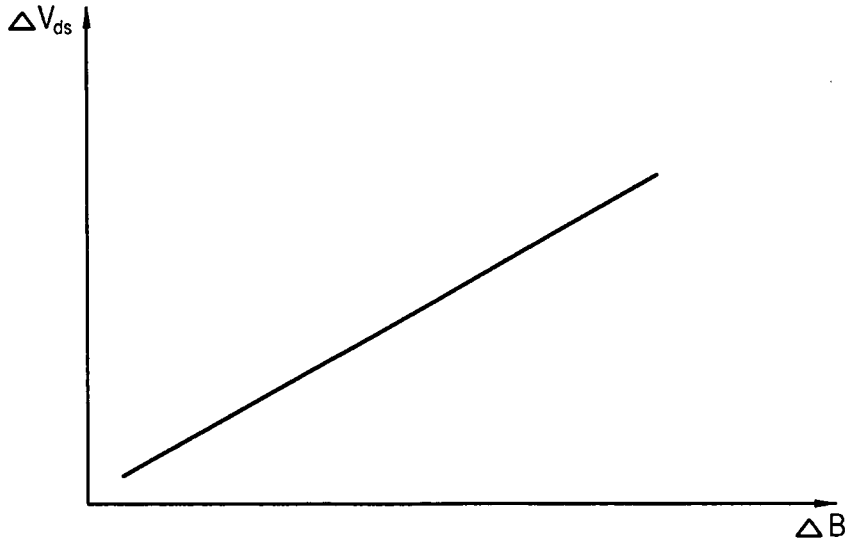
FIG. 3 illustrates a graph of a relationship between brightness and a driving voltage of the OLED display circuitry illustrated in FIG. 1.

Additionally, based on the above described relationship between driving current and driving voltage, the driving voltage determination unit 130 may store a second lookup table showing a driving voltage with respect to brightness (not shown) and/or a graph illustrating a relationship between the brightness and the driving voltage, such as illustrated in FIG. 3, and may employ one or more of these in the operation of an OLED display, for example. The second lookup table and/or the second graph may be embodied on a storage medium such as a computer-readable storage medium, for example.

Referring to FIG. 3, a graph of a brightness ΔB with respect to a driving voltage $\Delta V_{ds}$ is illustrated. The graph includes a regression line that may be obtained by employing existing data or experimental values, for example. The graph illustrated in FIG. 3 may have a slope wherein there is an increase of approximately 0.3V in a driving voltage for approximately every 50 cd/m2 increase in brightness, as just an example.

For example, in an OLED display utilizing a maximum brightness of approximately 150 cd/m$^2$ and a maximum driving voltage of approximately 9.5V, if the illuminance sensing unit 110 senses an external illuminance of approximately 500 lux, the brightness determination unit 120 may determine brightness as approximately 90 cd/m$^2$ according to the sensed external illuminance, and may transmit the second control signal $CS_2$ corresponding to the determined brightness to the driving voltage determination unit 130. The driving voltage determination unit 130 may determine a driving voltage as a voltage which is approximately 0.36V lower than the maximum driving voltage according to the second control signal $CS_2$. As one example, based on the maximum brightness, an increment ΔB (i.e., approximately −40%) of a brightness determined according to the external illuminance may be determined according to second control signal $CS_2$. The calculated brightness increment may be applied to the graph illustrated in FIG. 3 in order to obtain a driving voltage increment $\Delta V_{ds}$, i.e., approximately −0.36V. That is, the driving voltage is determined as approximately 9.14V which is approximately 0.36V lower than the maximum driving voltage, i.e., approximately 9.5V.

If the illuminance sensing unit 110 senses an external illuminance of approximately 60 lux, the brightness determination unit 120 may determine brightness corresponding to the external illuminance to be approximately 45 cd/m$^2$. The driving voltage determination unit 130 may calculate a brightness increment ΔB based on the determined brightness, and may calculate a driving voltage increment $\Delta V_{ds}$ according to the brightness increment ΔB. For example, a brightness increment ΔB is calculated as a reduction of approximately 70% based on the maximum brightness. By applying the brightness increment ΔB to the graph illustrated in FIG. 3, a driving voltage increment $\Delta V_{ds}$ may be determined as approximately −0.63V. Thus, the driving voltage may be determined as approximately 8.87V which is 0.63V lower than 9.5V.

Therefore, in the above-described two examples, a reduction in power consumption of about 4% and 7%, respectively, may be accomplished. However, it is worthwhile to note that the scope of the present invention is not limited in this respect.

Furthermore, referring again to FIG. 1, a third control signal $CS_3$ may be supplied to the voltage conversion unit 140 to control a driving voltage determined by the driving voltage determination unit 130. The driving voltage may be supplied by the driving voltage determination unit 130 to the display unit 160. The voltage conversion unit 140 may receive an input voltage $V_i$ from a power source unit 150, e.g., a lithium ion battery, and may convert the input voltage $V_i$ into a first voltage ELVDD that may be higher than the input voltage $V_i$ and a second voltage ELVSS that may be lower than the input voltage $V_i$. Accordingly, a voltage margin or voltage difference may exist between the first voltage ELVDD and the second voltage ELVSS. The first voltage ELVDD and the second voltage ELVSS may be supplied to the display unit 160.

The voltage conversion unit 140 may receive the third control signal $CS_3$ that may control the driving voltage supplied to the display unit 160, and may adjust the second voltage ELVSS according to the third control signal $CS_3$. In the voltage conversion unit 140, a variable resistance varying in response to the third control signal $CS_3$ may be connected to an output terminal of a circuit determining the second voltage ELVSS. Thus, the second voltage ELVSS may be adjusted using the variable resistance. The voltage conversion unit 140 may be described in greater detail with reference to FIGS. 4 and 5, later.

The current embodiment of the present invention may illustrate that the voltage conversion unit 140 may be capable of adjusting the second voltage ELVSS such that an adjusted driving voltage may be supplied to the display unit 160, but the scope of the present invention is not limited thereto. The second voltage ELVSS may also be adjusted using a lookup table and/or a graph illustrating a relationship between a driving voltage increment, brightness, a brightness increment, and/or a driving voltage with respect to a sensed illuminance, and the second voltage ELVSS.

Furthermore, continuing with FIG. 1, the first voltage ELVDD and the second voltage ELVSS generated in the voltage conversion unit 140 may be supplied to the display unit 160. The display unit 160 may include a plurality of pixels defined by a plurality of data lines $D_1$ through $D_n$ and a plurality of scan lines $S_1$ through $S_n$. Each pixel may include a driving transistor and an OLED.

The OLED display may further include a data driving unit 180 and a scan driving unit 190. The data driving unit 180 may be capable of supplying data voltages corresponding to image data to the pixels. The scan driving unit 190 may be capable of selectively supplying selection signals to the pixels to select pixels to be displayed. The data driving unit 180 may be further capable of supplying data voltages to the pixels via the data lines $D_1$ through $D_n$, and the scan driving unit 190 may be further capable of selectively supplying selection signals to the pixels via the scan lines $S_1$ through $S_n$, for example.

The data driving unit 180 may receive a sixth control signal $CS_6$ and image data RGB data from a control unit 170, and the scan driving unit 190 may receive a fifth control signal $CS_5$ from the control unit 170. The control unit 170 may generate image data RGB data corresponding to an input image signal video signal, and control signals $CS_4$, $CS_5$, and $CS_6$, e.g., a vertical synchronization signal, a horizontal synchronization signal, and a clock signal. The control unit 170 may generate the fourth control signal $CS_4$ controlling the first voltage ELVDD and the second voltage ELVSS, such that the first voltage ELVDD and the second voltage ELVSS may be stably supplied to the display unit 160 from the voltage conversion unit 140, and may additionally supply the fourth control signal $CS_4$ to the voltage conversion unit 140. The control unit 170 may receive a predetermined voltage $V_C$ from the power source unit 150 and perform the above-described signal processing.

Hereinafter, the voltage conversion unit 140 of the OLED display circuitry illustrated in FIG. 1 will be described in more detail with reference to FIGS. 4 and 5.

Figure 4:
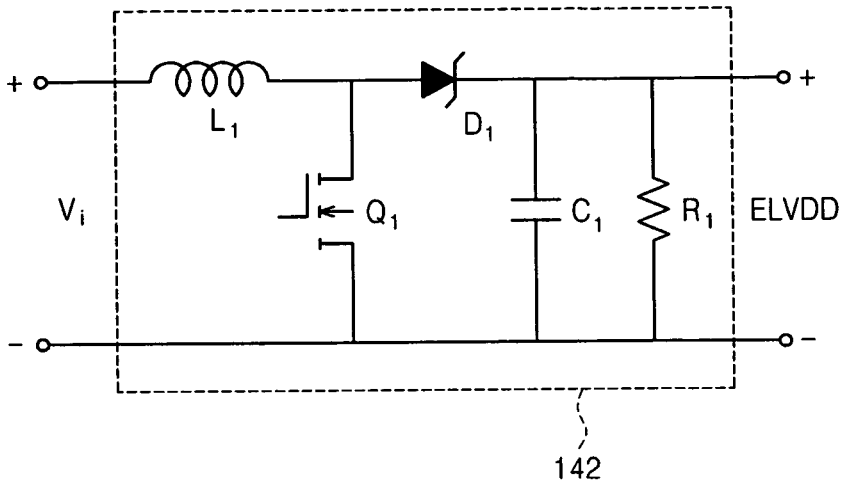
FIG. 4 illustrates a circuit diagram of a voltage conversion unit that may supply a first voltage to a display unit of the OLED display circuitry illustrated in FIG. 1.

FIG. 4 illustrates a circuit diagram of a portion of the voltage conversion unit 140. The voltage conversion unit 140 may be capable of supplying the first voltage ELVDD to the display unit 160 of the OLED display illustrated in FIG. 1. FIG. 5 illustrates a circuit diagram of a portion of the voltage conversion unit 140. The voltage conversion unit 140 may be capable of supplying the second voltage ELVSS to the display unit 160 of the OLED display illustrated in FIG. 1.

FIG. 4 illustrates a booster converter 142. The booster converter 142 may be capable of generating the first voltage ELVDD from the input voltage $V_i$. The booster converter 142 may include a first inductor $L_1$, a first switching device $Q_1$ which may be turned on/off in response to the fourth control signal $CS_4$ supplied from the control unit 170, a first reflux diode $D_1$, a first capacitor $C_1$, and a resistance $R_1$.

If the first switching device $Q_1$ is turned on in response to the fourth control signal $CS_4$, energy may be accumulated in the first inductor $L_1$, and charges accumulated in the first capacitor $C_1$ may be discharged and provided as an output. If the first switching device $Q_1$ is turned off in response to the fourth control signal $CS_4$, the energy accumulated in the inductor $L_1$ and the input voltage $V_1$ may be added to a voltage applied to both terminals of the first capacitor $C_1$, thereby outputting the first voltage ELVDD.

Figure 5:
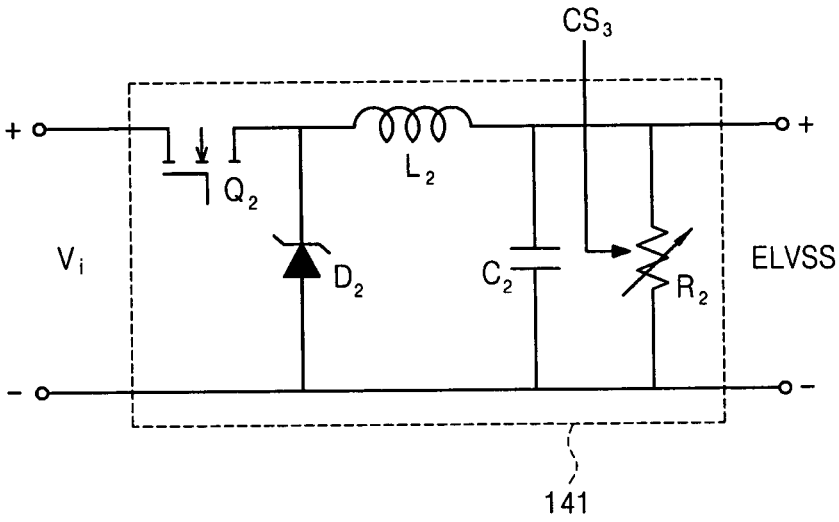
FIG. 5 illustrates a circuit diagram of a voltage conversion unit that may supply a second voltage to the display unit of the OLED display circuitry illustrated in FIG. 1.

FIG. 5 illustrates a buck converter 141 generating the second voltage ELVSS from the input voltage $V_i$, but the present invention is not limited thereto. The buck converter 141 may include a second switching device $Q_2$ which may be turned on/off in response to the fourth control signal $CS_4$, a second reflux diode $D_2$, and a low pass filter including a second inductor $L_2$ and a second capacitor $C_2$. A variable resistance $R_2$ may be connected to both terminals of the second capacitor $C_2$, and thus, the buck converter 141 may be capable of adjusting the second voltage ELVSS according to the variable resistance $R_2$.

The third control signal $CS_3$ may control a driving voltage determined by the driving voltage determination unit 130. The driving voltage determined by the driving voltage determination unit 130 may then be supplied to the display unit 160. The variable resistance $R_2$ may adjust the second voltage ELVSS according to the driving voltage.

If the second switching device $Q_2$ is turned on in response to the fourth control signal $CS_4$, the input voltage $V_i$ may be output through the low pass filter. If the second switching device $Q_2$ is turned off in response to the fourth control signal $CS_4$, energy accumulated in the second inductor $L_2$ may be discharged through the second reflux diode $D_2$ and output. At this time, the second voltage ELVSS may be adjusted by the variable resistance $R_2$. Variable resistance $R_2$ may vary in response to the third control signal $CS_3$. The third control signal $CS_3$ may control the driving voltage determined by the driving voltage determination unit 130. The driving voltage determination unit may be supplied to the display unit 160.

The first voltage ELVDD and the second voltage ELVSS may be applied to driving transistors and OLEDs of the display unit 160. A detailed description thereof will be provided hereinafter with reference to FIG. 6.

Figure 6:
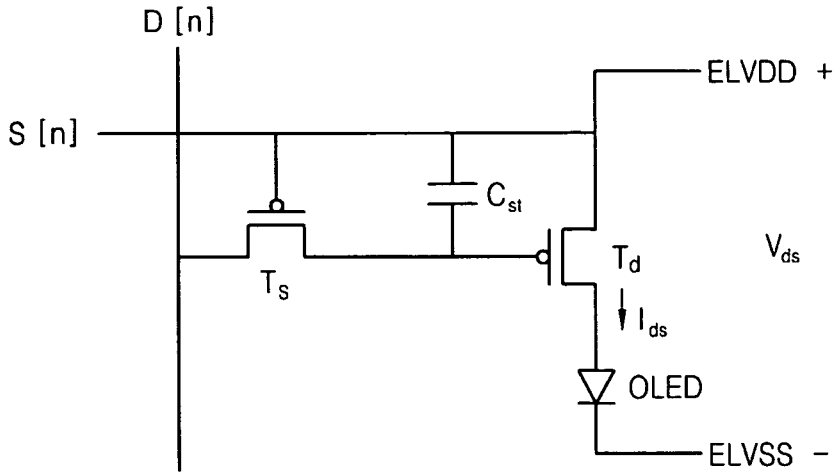
FIG. 6 illustrates a circuit diagram of a unit pixel of an OLED display according to an embodiment of the present invention.

Illustrated in FIG. 6 is a unit pixel of an OLED display. The unit pixel may be capable of receiving a first voltage and a second voltage, but the present invention is not limited thereto.

In FIG. 6, a unit pixel may be defined by a scan line S[n] and a data line D[n]. The scan line S[n] may be connected to a gate electrode of a switch transistor $T_S$, a first electrode of the switch transistor $T_S$ may be connected to the data line D[n], and a second electrode of the switch transistor $T_S$ may be connected to a first terminal of a capacitor $C_{st}$ and a gate electrode of a driving transistor $T_d$.

A first voltage ELVDD may be applied to a first terminal of the driving transistor $T_d$ and a second terminal of the capacitor $C_{st}$. A second terminal of the driving transistor $T_d$ may be connected to an anode of an OLED, and a second voltage ELVSS is applied to a cathode of the OLED.

In the current embodiment of the present invention, the second voltage ELVSS may be adjusted to supply a driving voltage $V_{ds}$ determined by a driving voltage determination unit (element 130 of FIG. 1) to a display unit (element 160 of FIG. 1). The adjusted second voltage ELVSS may be supplied to the cathode of the OLED.

The OLED may receive a driving current $I_{ds}$. The driving current $I_{ds}$ may be determined by a data voltage supplied from the gate electrode of the driving transistor $T_d$. The OLED may further receive the first voltage ELVDD applied to a first electrode of the driving transistor $T_d$, and may emit light. In this example, the driving current $I_{ds}$ may determine brightness.

If the first voltage ELVDD is adjusted to supply a driving voltage determined according to a sensed illuminance to the display unit, the driving current $I_{ds}$ and the brightness may be changed. Thus, in order to correct the changed brightness to a desired brightness, a driving procedure, e.g., an adjustment of a data voltage, may be performed. In one embodiment, the second voltage ELVSS may be adjusted to correct the changed brightness rather than adjusting the first voltage ELVDD, so that the voltage adjustment does not affect the driving current $I_{ds}$.

While the present invention has been particularly shown and described with reference to exemplary embodiments thereof, it will be understood by those of ordinary skill in the art that various changes in form and details may be made therein without departing from the spirit and scope of the present invention as defined by the following claims.

As described above, according to embodiments of OLED display and a method of driving the same in accordance with the present invention, based on the characteristics of a driving voltage at a current saturation point which varies according to brightness, a driving voltage may be determined so as to maintain a driving voltage margin, for example. That is, the brightness of an OLED display may be determined to vary according to an external illuminance, and a driving voltage at a current saturation point may be determined according to the variable brightness, and thereby constantly maintain a driving voltage margin. A reduction in power consumption of the OLED display may therefore be realized.

In addition, according to embodiments of the present invention, a voltage applied to a cathode of an OLED may be adjusted so as to supply a determined driving voltage to a display unit. The voltage supplied to the cathode of an OLED may be adjusted without affecting a driving current supplied to the OLED. Adjusting a determined driving voltage without affecting a driving current supplied to an OLED may make operation of an OLED display easier.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of embodiments of the present invention as set forth in the following claims.

What is claimed is:

1. An organic light emitting diode (OLED) display, comprising:

a display unit configured to display an image, the display unit including at least one OLED, the OLED having an anode and a cathode;

an illuminance sensing unit configured to sense an ambient illuminance;

a brightness determination unit configured to select a brightness for the OLED display according to the ambient illuminance sensed by the illuminance sensing unit;

a driving voltage determination unit configured to determine a driving voltage corresponding with a current saturation point of the OLED display, the driving voltage being determined based at least in part on a driving current and the brightness selected by the brightness determination unit, and to constantly maintain a driving voltage margin, the driving voltage being applied across the anode and the cathode of the OLED; and a voltage conversion unit, the voltage conversion unit being configured to receive an input voltage, and generate a first voltage higher than the input voltage and generate a second voltage lower than the input voltage, the first voltage being supplied to the anode of the OLED and the second voltage being supplied to the cathode of the OLED so as to apply the driving voltage across the anode and the cathode of the OLED, and the voltage conversion unit being configured to adjust the second voltage in accordance with the driving voltage of the driving voltage determination unit, adjusting the second voltage including raising the second voltage as the brightness of the OLED display decreases so as to reduce a voltage difference applied across the anode and the cathode of the OLED at the current saturation point, wherein:

the driving voltage determination unit is configured to access a second lookup table, the second lookup table providing the driving voltage at a current saturation point of the OLED display corresponding with the selected brightness for the OLED display.

2. The OLED display as claimed in claim 1, wherein the illuminance sensing unit comprises a photosensor.

3. The OLED display as claimed in claim 1, wherein the brightness determination unit is configured to access a first lookup table of brightness values of the OLED display corresponding with the ambient illuminance.

4. The OLED display as claimed in claim 1, wherein the display unit includes a plurality of pixels, each pixel having:

a driving transistor having a gate electrode and a first electrode, the gate electrode configured to receive a data voltage and the first electrode configured to receive the first voltage; and an OLED having an anode connected to a second electrode of the driving transistor and a cathode configured to receive the second voltage.

5. The OLED display as claimed in claim 1, wherein the voltage conversion unit includes a variable resistance for adjusting the driving voltage and generating the second voltage.

6. The OLED display as claimed in claim 5, wherein the voltage conversion unit comprises:

a booster converter configured to generate the first voltage; and a buck converter configured to generate the second voltage.

7. The OLED display as claimed in claim 6, wherein the buck converter includes a variable resistance and is configured to adjust the variable resistance based at least in part on the driving voltage determined by the driving voltage determination unit.

8. The OLED display as claimed in claim 7, wherein the buck converter turns off a second switching device in response to a fourth control signal such that energy accumulated in a second inductor is discharged through a reflux diode and output, and the second voltage is generated based on the variable resistance.

9. The OLED display as claimed in claim 6, wherein the booster converter turns off a first switching device in response to a fourth control signal such that energy accumulated in a first inductor and the input voltage is added to a first capacitor voltage applied to both terminals of a first capacitor so that the first voltage is generated.

10. The OLED display as claimed in claim 1, wherein:

the illuminance sensing unit outputs a first control signal to the brightness determination unit;

the brightness determination unit outputs a second control signal to the driving voltage determination unit;

the driving voltage determination unit outputs a third control signal to control the driving voltage; and the voltage conversion unit receives a fourth control signal from a control unit and the third control signal from the driving voltage determination unit.

11. The OLED display as claimed in claim 10, wherein:

the control unit receives a predetermined voltage and is configured to generate the fourth control signal, a fifth control signal, a sixth control signal, and an image RGB data corresponding to an input image video signal.

12. A method of driving an organic light emitting diode (OLED) display, the method comprising:

sensing an ambient illuminance;

selecting a brightness for the OLED display according to the sensed ambient illuminance;

determining a driving voltage at a current saturation point for the OLED display based at least in part on a driving current corresponding to the selected brightness, and to constantly maintain a driving voltage margin, the driving voltage being applied across an anode and a cathode of an OLED of the display;

receiving an input voltage from an input voltage source;

generating a first voltage higher than the input voltage and generating a second voltage lower than the input voltage, the first voltage being supplied to the anode of the OLED and the second voltage being supplied to the cathode of the OLED so as to apply the driving voltage across the anode and the cathode of the OLED; and adjusting the second voltage based on the determined driving voltage, adjusting the second voltage including raising the second voltage as the brightness of the OLED display decreases so as to reduce a voltage difference applied across the anode and the cathode of the OLED at the current saturation point, wherein:

the determining of the driving voltage includes accessing a lookup table of the driving voltage at a current saturation point of the OLED display corresponding with the selected brightness for the OLED display.

13. The method as claimed in claim 12, wherein the selecting of the brightness for the OLED display includes accessing a first lookup table of brightness values of the OLED display corresponding with the ambient illuminance.

14. The method as claimed in claim 12, wherein the selecting of the brightness for the OLED display includes accessing a first graph of brightness values of the OLED display corresponding with the ambient illuminance.

15. The method as claimed in claim 12, wherein the determining of the driving voltage includes accessing a graph of driving voltages of the OLED display corresponding with the selected brightness for the OLED display.

16. The method as claimed in claim 12, wherein the generation of the second voltage includes adjusting a resistance of a variable resistor in accordance with a control signal corresponding to the determined driving voltage.

17. The method as claimed in claim 12, wherein the display unit comprises a plurality of pixels, each pixel having:

a driving transistor having a gate electrode receiving a data voltage; and an OLED having an anode and a cathode, the first voltage being supplied to the first electrode of the driving transistor.

* * * * *